US005196127A

United States Patent [19]

Solell

[11] Patent Number: 5,196,127

[45] Date of Patent: Mar. 23, 1993

[54] ICE CUBE TRAY WITH COVER

[76] Inventor: Zev Solell, 41 W. 71st St., New York, N.Y. 10023

[21] Appl. No.: 836,537

[22] Filed: Feb. 19, 1992

Related U.S. Application Data

[63] Continuation of Ser. No. 418,119, Oct. 6, 1989, abandoned.

[51] Int. Cl.[5] ..... B28B 7/24

[52] U.S. Cl. ..... 249/121; 249/126; 249/127; 221/91

[58] Field of Search ..... 249/69, 121, 126, 203, 249/70, 77, 127, 126; 220/345, 351; 221/91; D15/90

[56] References Cited

U.S. PATENT DOCUMENTS

| | | | |
|---|---|---|---|
| 2,503,693 | 4/1950 | Van Lennep | 249/121 |
| 3,019,617 | 2/1962 | Malthaner et al. | 249/121 |
| 3,135,101 | 6/1964 | Nigro | 249/127 |
| 3,374,982 | 3/1968 | Sallade | 249/121 |
| 3,414,229 | 12/1968 | Norberg | 249/121 |
| 3,443,785 | 5/1969 | Ewers | 249/126 |
| 3,776,504 | 12/1973 | Wiley | 249/121 |
| 4,366,941 | 1/1983 | Harris | 249/121 |
| 4,432,529 | 2/1984 | McMillan | 249/126 |

*Primary Examiner*—Jay H. Woo
*Assistant Examiner*—Khanh P. Nguyen
*Attorney, Agent, or Firm*—Curtis, Morris & Safford

[57] ABSTRACT

A stackable, covered ice cube tray apparatus including a base member having four side walls, each side wall having a lower end and a top end, wherein said side walls and bottom wall form a basin for storage of a liquid. The apparatus further includes a cover having a substantially rigid member having a front end, two edges and a rear end, the front end having a handle contiguous thereto. A vertically disposed sealing and prevention channel is positioned contiguous to the top end of the side walls of the basin. The channel compresses an upper channel having means therein to slidably receive the cover and a lower channel having means for the prevention of spilling of liquid when the basin is jostled or tilted. This dual channel system provides both a splash guard and sealing means to substantially eliminate spillage of liquid when the apparatus is moved.

12 Claims, 4 Drawing Sheets

ICE CUBE TRAY WITH COVER

This application is a continuation of application Ser. No. 07/418,119, filed Oct. 6, 1989, now abandoned.

FIELD OF THE INVENTION

This invention relates generally to a covered ice cube tray, and more particularly, to a covered ice cube tray that will substantially diminish water spills from the tray and is easily stackable within a freezer compartment.

BACKGROUND OF THE INVENTION

It is known in the art to provide ice cube trays and also ice cube trays with covers. However, known ice cube trays do not adequately prevent spillage from the tray when the tray is moved or tilted and do not provide a convenient structure that is easily stackable within a freezer.

In the past, ice cube trays with covers have consisted of a subdivided base member and a cover that either snaps on or slides onto a lip located around the edges of the base member (See U.S. Pat. Nos. 2,804,755; 2,503,693; 4,057,166 and 4,343,403). Although these ice cube trays are stackable, they do not provide means to eliminate spills when the tray is tilted. The lip provides minimal protection against splashing of the liquid, however, when the tray is jostled, the water spills over the edges of the lip. The present invention avoids these problems by having a dual channel: namely, a lower channel to protect against splashes and an upper channel to house the cover and to create a seal that substantially eliminates any spills when the tray is inadvertently jostled or tilted.

OBJECT OF THE INVENTION

It is a general object of the present invention to provide an improved ice cube tray.

It is another object of this invention to provide an ice cube tray with a sliding cover that will substantially eliminate water spills when it is moved or jostled.

It is a further object of this invention to provide an ice cube tray that is made of a flexible plastic material and cooperates with a rigid cover to block water from spilling from the tray when the tray is in motion or tilted.

It is yet another object of this invention to provide an ice cube tray having a dual channel which not only provides a splash guard to avoid spills but also provides a seal that substantially eliminates any spills when the tray is inadvertently jostled or tilted.

It is yet a further object of this invention to provide an ice cube tray having a cover that slidably engages an inner channel within the underlying tray.

It is yet still another object of this invention to provide an ice cube tray having a cover with a handle which allows the cover to easily slide over the underlying tray and also prevents spillage from the front-end of the tray.

It is still another object of this invention to provide an ice cube tray that is made of a flexible plastic material and cooperates with a substantially flexible cover so that the ice cubes can be loosened from the underlying tray with the cover in place.

Various other objects, advantages and features of the present invention will become readily apparent from the ensuing detailed description and the novel features will be particularly pointed out in the appended claims.

SUMMARY OF THE INVENTION

These and other objects of the invention are achieved in a covered ice cube tray of the present invention which includes a substantially rectangular base member having a bottom and four side walls. Each of the side walls has a lower and a top end and the side walls and bottom walls form a basin for the storage of liquid. These four side walls consist of a first wall, second wall, third wall and a fourth wall such that the first and third walls are substantially parallel to each other and the second and fourth side walls are substantially parallel to each other. The first and third side walls are substantially equivalent in length and the second and fourth side walls are substantially equivalent in length. The first and third side walls are shorter than the second and fourth side walls.

A vertically disposed sealing and leakage prevention dual channel having upper and lower channels is located contiguous to the top end of these four side walls. The channel includes a top face, a rear face and a lower face with a partition dividing these channels into the upper and lower channels. The upper channel is defined by said top face, rear face and the partition, and the lower channel is defined by the partition, rear face and lower face. The lower channel has a width and depth such that the width and depth are substantially equivalent along all four sides thereof. The width of the upper channel along the first and third walls is greater than the width of the upper channel along the second and fourth side walls.

A slot is located on the rear face of the channel immediately above the first side wall. This slot is sized to receive the cover and has a length less than the length of the first side wall and a width substantially equivalent to the depth of the upper channel. Further, the slot has at least two outwardly extended web members on either side thereof.

The cover includes a substantially rigid member having a thickness less than the depth of the upper channel and width of the slot. The cover has a front end, two side surfaces and a rear end with the front end having a handle located contiguous thereto. The handle has a thickness greater than the depth of the upper channel and width of the slot and has a front edge which mates with the outwardly extended web members located on either side of the slot to form a seal between the web members and the handle. As such, spillage of liquid from said slot when the tray is moved or tilted is prevented. The rear end of the cover extends through the slot, with the side surfaces of the cover sliding along the upper channel above said second and fourth side walls. The rear end slides into the upper channel located above the third side wall when the cover is in its final position. The additional width of the upper channel along the third side wall creates a seal for the cover when it is in its final position and thereby substantially eliminates any risk of the cover being unintentionally released from the channel and substantially eliminates spillage and leakage of the liquid from the tray.

The following detailed description of an illustrative embodiment is to be read in connection with the accompanying drawings.

DETAILED DESCRIPTION OF A PREFERRED EMBODIMENT

Figure 1:
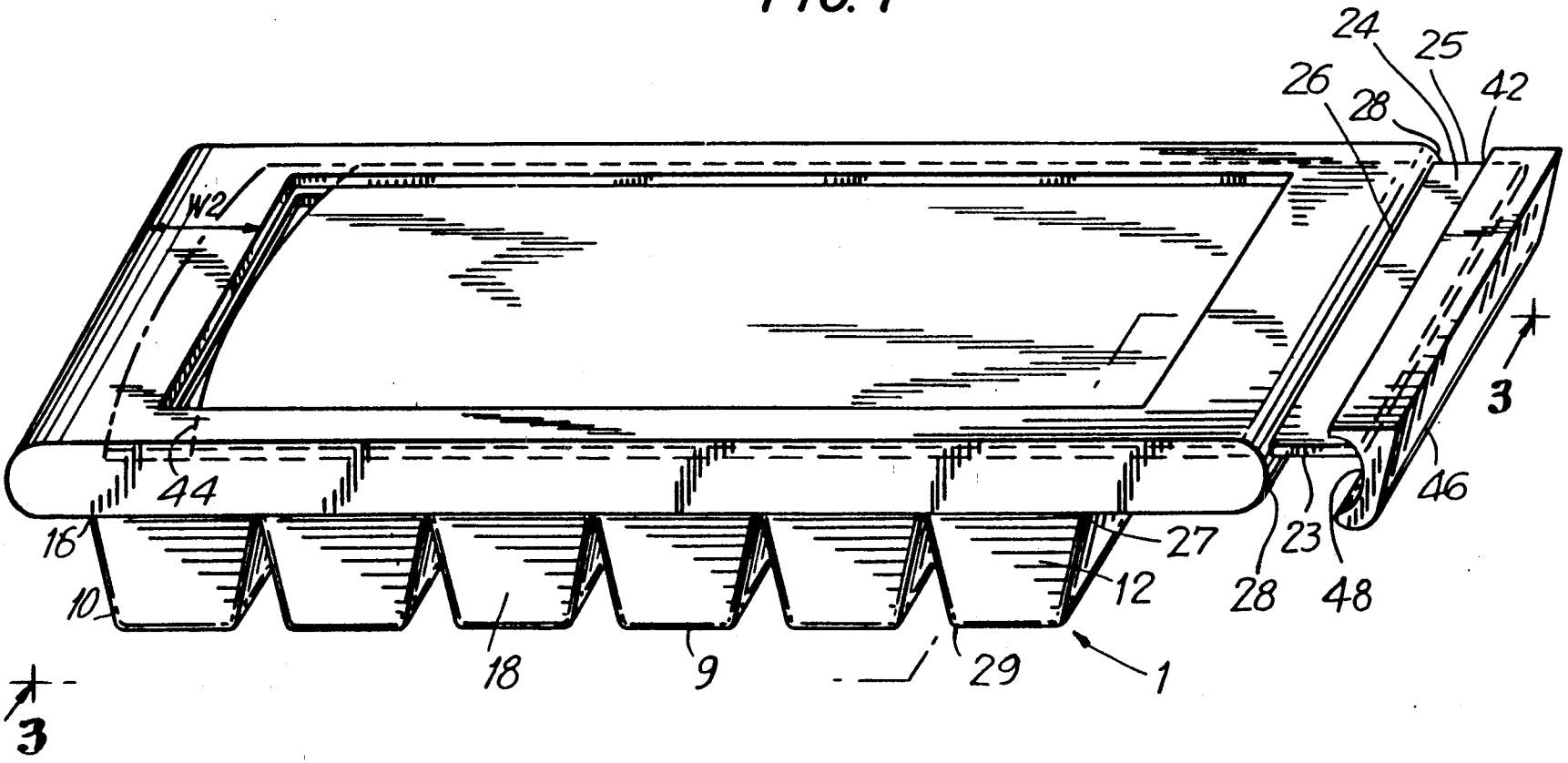
FIG. 1 is a perspective view of a covered ice cube tray in accordance with a preferred embodiment of the present invention.

Referring initially to FIG. 1, a covered ice cube tray 1 in accordance with a preferred embodiment of the present invention is illustrated. The tray generally includes a substantially rectangular housing 10 having a bottom 9 and four side walls 12, 14, 16, 18, respectively. Each side wall 12, 14, 16 and 18, has a top end 27 and a bottom end 29. The side walls, 12, 14, 16 and 18, and bottom 9 form a basin 10 for storage of a liquid.

Figure 2:
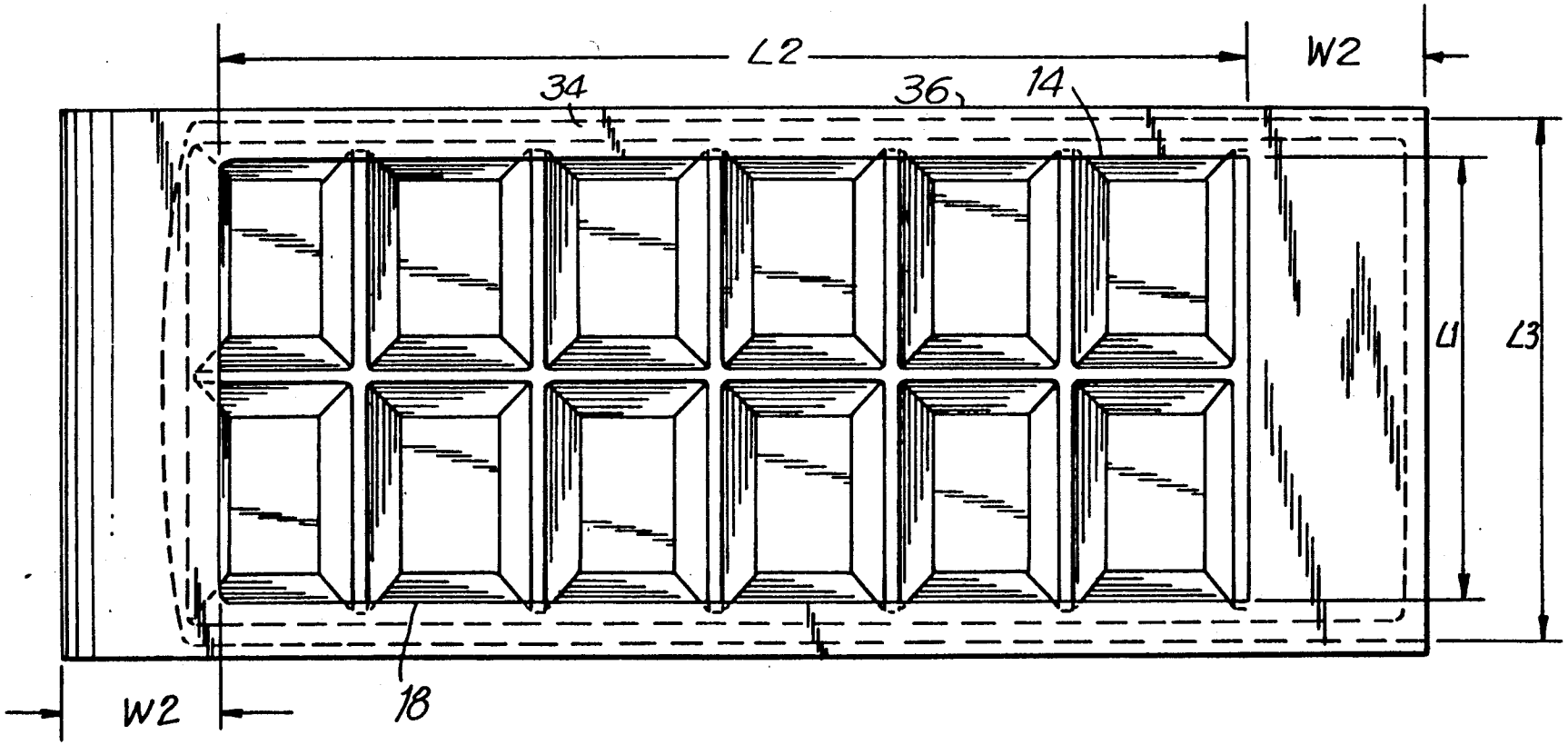
FIG. 2 is a top elevational view of the ice cube tray of FIG. 1.
Figure 3:
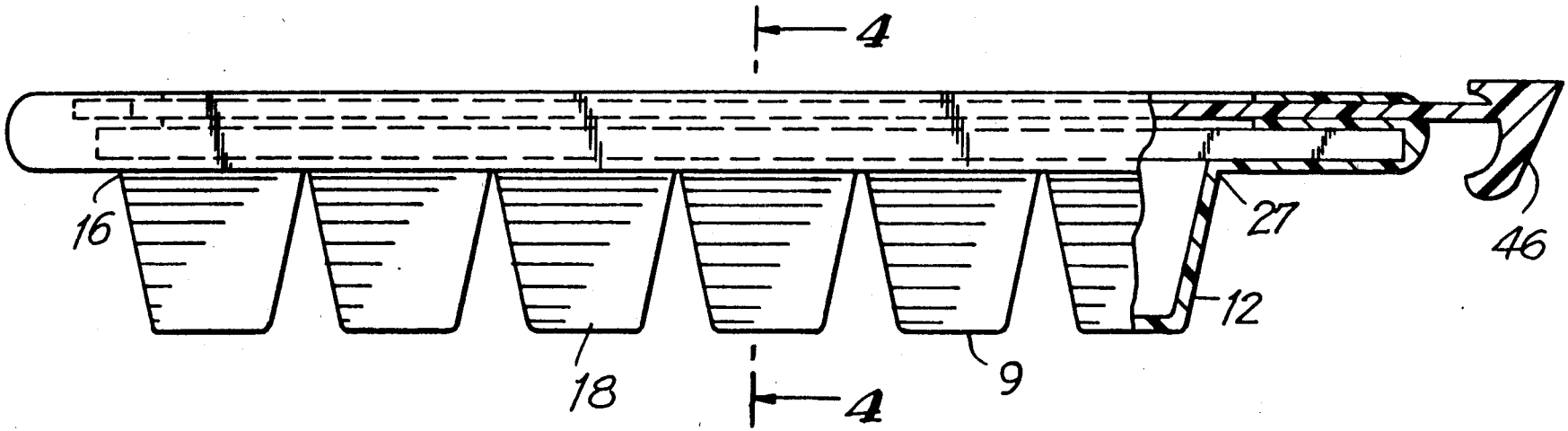
FIG. 3 is a side cross sectional view taken along line 3—3 of FIG. 1.

These four side walls consist of a first side wall 12, a second side wall 14, a third side wall 16 and a fourth side wall 18. The first side wall 12 and third side wall 16 are substantially parallel to each other and the second side wall 14 and fourth side wall 18 are substantially parallel to each other. The first and third side walls 12 and 16, respectively, are substantially equivalent in length and the second and fourth side walls, 14 and 18, respectively, are substantially equivalent in length. The length L1 of the first and third side walls, 12 and 16, is shorter than the length L2 of the second and fourth side walls, 14 and 18 (FIG. 2).

Figure 4:
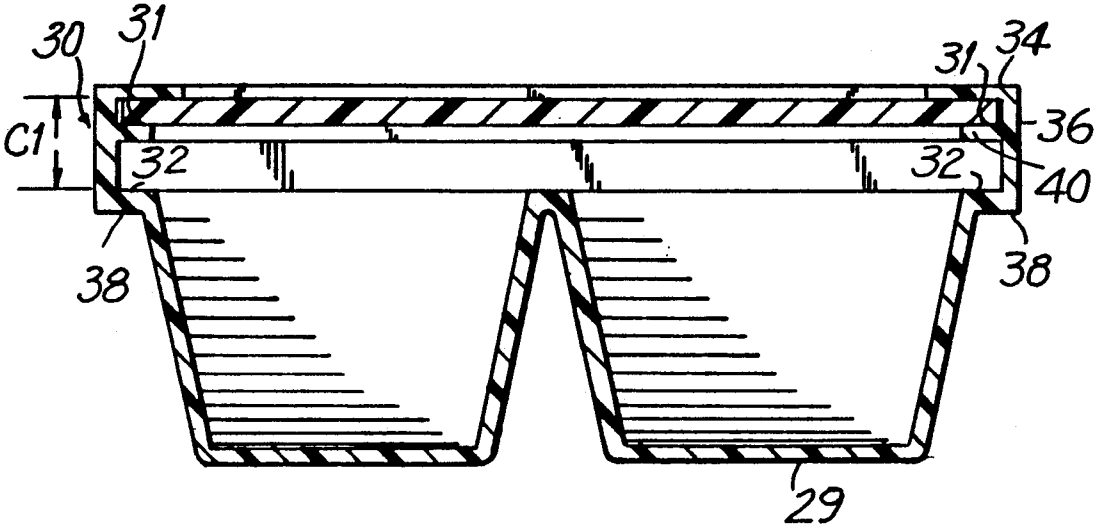
FIG. 4 is a side elevational view taken along line 4—4 of FIG. 3.

A vertically sealing and leakage prevention channel 30 including an upper channel 31 and a lower channel 32 is located contiguous to the top end 27 of the side walls 12, 14, 16 and 18 (FIG. 4). The channel 30 includes a top face 34, a rear face 36 and a lower face 38. A partition 40 divides the channel 30 into the upper channel 31 and lower channel 32. The upper channel 31 is defined by the top face 34, rear face 36 and the partition 40. The lower channel 32 is defined by the partition 40, rear face 36 and lower face 38. The lower channel 32 has a width W1 and depth D1 as shown in FIG. 4. The depth D1 and width W1 of the lower channel 32 is approximately equivalent along all four sides of the lower channel 32. As is seen in the figures, particularly FIG. 1 and 2, the channel 30 is located above all four sides of the basin 10.

The lower channel 32 provides a convenient splash guard to prevent spilling of liquid when the tray is tilted or jostled. The lower channel 32 also provides additional protection when the basin is overfilled with liquid. The additional liquid is "trapped" within this lower channel and does not spill out onto the user when the tray is moved.

The upper channel 31 has an upper width W2 and an upper depth D2 as seen in FIG. 4. The upper width W2 of the upper channel 31 along the first and third side walls, 12 and 16 respectively, is greater than the upper width W2 of the upper channel 31 along the second and fourth side walls 14 and 18 respectively (FIG. 1 and 2). The upper width W2 of the upper channel 31 along the first side wall 12 and third side walls 16 do not need to be equivalent, however, this width W2 will always be greater than the upper width W2 of the upper channel 31 along the second and fourth side walls, 14 and 18. The upper width W2 of the upper channel 31 along the second side wall 14 and fourth side wall 10 will be approximately equivalent to the width W1 of the lower channel 32.

A slot 26 is located on the rear face 36 of the channel 30 immediately above the first side wall 12. The slot 26 has a length L3 which is slightly greater than the length L1 of the first side wall 12 and a width substantially equivalent to the upper depth D2 of the upper channel 31 and is sized to receive the cover 24. The slot 26 has an outwardly extending web member 28 on either side thereof.

The cover 24 includes a substantially rigid member having a thickness less than the upper depth D2 of the upper channel 31 and the slot 26. The cover has a front end 42, two edges 23 and 25 and a rear end 44, the front end 42 has a handle 46 located contiguous thereto. The handle 46 has a thickness greater than the upper depth D2 of the upper channel 31 and the depth of the slot 26. The handle 46 has a curved first end 48 which mates with the curved outwardly extending web members 28 of the slot 26 to form a seal therebetween to avoid spilling of a liquid from the slot 26 when the ice cube tray 1 is moved or tilted.

The rear end 44 of the cover 24 extends through the slot 26, the edges 23 and 25, respectively, of the cover 24 are slidably received and retained within the upper channel 31 located above the second and fourth side walls, 14 and 18 respectively. The rear end 44 of the cover is slidably received and retained within the upper channel 31 located above the third side wall 16 when the cover is in its final position. The upper width W2 of the upper channel 31 along this third side wall 1 is deeper than the width along the second and fourth walls 14 and 18. This additional width enables the cover to be locked into place when the cover is in the final position and also provides an additional seal to avoid any spilling of liquid when the apparatus is moved. Further, the additional width of the upper channel along the first wall provides an additional sealing function with respect to the front end 48. This arrangement of the cover in its final position and the seal created at the first and third walls provides an apparatus that substantially eliminates any risk of the cover popping out of the channel and substantially eliminates spillage and leakage of liquid from the tray.

As is seen in FIG. 1, the outwardly extending web members 28 on either side of the slot 26 have a generally semicircular appearance. Further, the front end 48 of the handle 46 of the cover 24 has a C-shaped portion that substantially replicates the semicircular appearance of these outwardly extending web members 28 to provide a mating system and therefore, a seal is created between these outwardly extending web members and the front end of the handle. However, the shape of the web members 28 and the front end of the handle is not limited to this semicircular shape. It can be any configuration as long as the front end of the handle replicates the shape of the web members. The seal between these outwardly extending web members and the front end of the handle is created either by friction or the addition of some rubber sealant on the front end 48 of the handle 24 or any convenient means similar thereto.

Further this arrangement of a substantial rectangular base member with a substantially rigid cover that is slid along a channel located within the base member creates a convenient apparatus that is easily stackable within a freezer compartment. The top surface of the apparatus is substantially flat as is the bottom basin of this ice cube tray and, therefore, many of these trays can be stacked one on top of each other conveniently within a freezer compartment.

Further, the handle 42 has many advantages. First it is shaped for the convenience of the user to easily remove and insert the cover along the upper channel of the tray. Further the additional thickness of the handle is yet another means to avoid spilling of the liquid when the tray is jostled. The extended width of the upper channel located above the first wall 12 provides additional support for the cover 24 and also an extended splash guard to diminish any spills from the first end of the tray.

In another embodiment of the invention (not shown), the cover includes a substantially flexible member. The flexible tray and flexible cover cooperate with each other so that the ice cubes can be loosened from the underlying tray with the cover in place.

Figure 5:
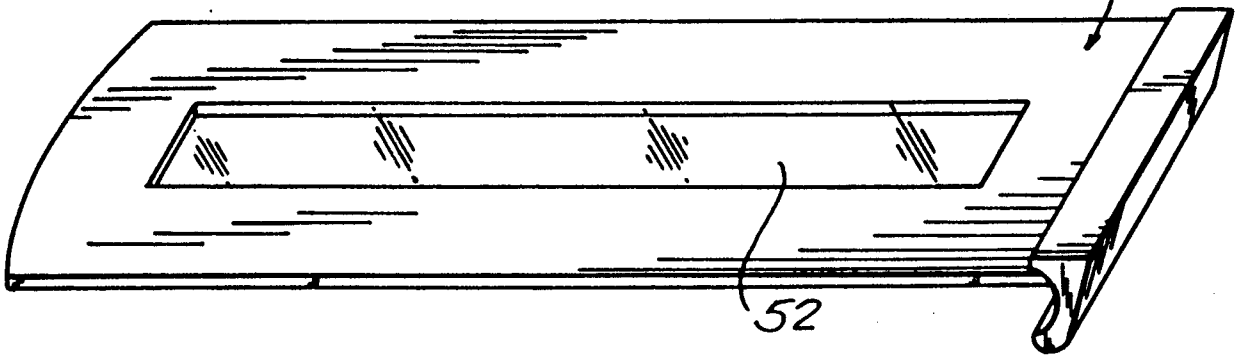

Further, in yet another embodiment of the invention (FIG. 5), the cover 50 has a narrow opening 52 located perpendicular to the front end and rear end of the cover and is in the center thereof. This opening 50 enables the user to fill the underlying tray with water while the cover is in place. Thus, this cover 50 still substantially diminishes spills when the tray is jostled and further provides a more convenient apparatus for the user.

Although an illustrative embodiment of the invention has been described in detail herein, it is to be understood that the invention is not limited to the foregoing, and that various modifications and changes may be effected therein by one skilled in the art without departing from the scope or spirit of the invention as defined in the appended claims.

What is claimed is:

1. An ice cube tray assembly comprising:

a substantially rectangular tray housing in which a liquid is transformed into a plurality of ice cubes and a tray cover for said tray housing, said tray housing having an internal cavity with means for defining a plurality of ice cube tray compartments, said housing including a sealing and spill-prevention means formed inwardly of said housing for receiving said cover and preventing spillage of the liquid, said sealing and spill-prevention means including an upper channel having means therein to slidably receive and retain said cover within said housing and a lower channel having means to prevent spillage of the liquid when said housing is moved and further including a top face extending inwardly of said housing, a rear face depending downwardly from said top face, a lower face extending inwardly from said rear face and a partition extending inwardly from said rear face between said top and lower faces, said upper channel being defined by said top face, said rear face and said partition and said lower channel being defined by said partition, said rear face and said lower face;

said cover being removable, substantially flat and of unitary construction and being slidably insertable into said upper channel so as to overlie said internal cavity and having a centrally located longitudinal opening exposing a substantial portion of the internal cavity of the ice cube tray housing containing said plurality of ice cube compartments.

2. The ice cube tray assembly as set forth in claim 1, wherein said internal cavity is formed by a bottom and four side walls each formed of an inclined surface extending generally upwardly from said bottom.

3. The ice cube tray assembly as set forth in claim 2, wherein said sealing and spill-prevention means is formed above and adjacent to said generally upwardly extending inclined surface.

4. The ice cube tray assembly as set forth in claim 2, wherein said lower face is joined to said generally upwardly extending inclined surfaces.

5. The ice cube tray assembly as set forth in claim 1 wherein said tray housing is made of a flexible, plastic material.

6. The ice cube tray assembly as set forth in claim 1 wherein said cover is made of rigid, plastic material.

7. An ice cube tray assembly comprising:

a substantially rectangular tray housing in which a liquid is transformed into a plurality of ice cubes and a tray cover for said tray housing;

said tray housing being of unitary construction and including a sealing and spill-prevention means formed inwardly of said housing for receiving said cover and preventing spillage of the liquid, said sealing and spill-prevention means including an upper channel having means therein to slidably receive and retain said cover within said housing and a lower channel having means to prevent spillage of the liquid when said housing is moved and further including a top face extending inwardly of said housing, a rear face depending donwardly from said top face, a lower face extending inwardly from said rear face and a partition extending inwardly from said rear face between said top and lower faces, said upper channel being defined by said top face, said rear face and said partition and said lower channel being defined by said partition, said rear face and said lower face;

said cover being removable, substantially flat and slidably insertable into said upper channel so as to overlie said housing and including means to seal the liquid in place within said tray housing and prevent spillage therefrom.

8. The ice cube tray assembly of claim 7 wherein said rear face has formed therein a slot for receiving said tray cover when said tray cover is inserted into said tray housing and said sealing means includes handle means formed integrally with said tray cover which covers said slot.

9. The ice cube tray assembly of claim 8 wherein said handle means includes a generally C-shaped section which is capable of mating engagement with a generally curved section of said tray housing surrounding said slot when said cover overlies said tray housing.

10. The ice cube tray assembly of claim 9 wherein a rubber sealant is applied to said C-shaped section to secure said C-shaped section to said generally curved section of said tray housing.

11. An ice cube tray assembly comprising:

a substantially rectangular tray housing in which a liquid is transformed into a plurality of ice cubes and a tray for said tray housing, said tray housing having an internal cavity with means for defining a plurality of ice cube tray compartments, said housing including a sealing and spill-prevention means formed inwardly of said housing for receiving said cover and preventing spillage of the liquid, said sealing and spill-prevention means including an upper channel having means therein to slidably receive and retain said cover within said housing, and a lower channel having means to prevent spillage of liquid when said housing is moved; said sealing and spill-prevention means including a top face extending inwardly of said housing, a rear face depending downwardly from said top face, a lower face extending inwardly from said rear face, and a partition extending inwardly from said rear face between said top and lower faces; said upper channel being defined by said top face, said rear face and said partition; said lower channel being defined by said partition, said rear face and said lower face; said rear face having formed therein a slot for receiving said tray cover when said tray cover is inserted into said tray housing;

said cover being removable, substantially flat and of unitary construction and being slidably insertable into said upper channel so as to overlie aid internal cavity and having a centrally located longitudinal opening exposing a substantial portion of the internal cavity of the ice cube tray housing containing said plurality of ice cube compartments; said cover also including means to seal said liquid in place in said tray housing and prevent spillage therefrom , said sealing means including handle means formed integrally with said tray cover which covers said slot, said handle means having a generally C-shaped section which is capable of mating engagement with a generally curved section of said tray housing surrounding said slot means when said cover overlies said internal cavity.

12. The ice cube tray assembly as set forth in claim 4, wherein said rear face has formed therein a slot for receiving said tray cover when said tray cover is inserted into said tray housing, said slot extending horizontally above one of said side walls.

* * * * *